United States Patent [19]

Bell

[11] Patent Number: 4,758,809

[45] Date of Patent: Jul. 19, 1988

[54] ELECTROMAGNETIC RELAY HAVING A MULTIFUNCTION RETAINING SPRING

[75] Inventor: Richard E. Bell, Princeton, Ind.

[73] Assignee: Potter and Brumfield Inc., Princeton, Ind.

[21] Appl. No.: 97,996

[22] Filed: Sep. 17, 1987

[51] Int. Cl.[4] ..... H01H 67/02

[52] U.S. Cl. ..... 335/128; 335/80; 335/83; 335/85

[58] Field of Search ..... 335/78, 80, 81, 82, 335/83, 84, 128, 129, 130, 131, 132, 85

[56] References Cited

U.S. PATENT DOCUMENTS

| | | | |
|---|---|---|---|
| 3,365,683 | 1/1968 | Aidn et al. . | |
| 3,406,361 | 10/1968 | Le Mauviel | 335/178 |
| 4,045,755 | 8/1977 | Schroeder et al. | 335/274 |
| 4,302,742 | 11/1981 | Schedele | 335/202 |
| 4,316,164 | 2/1982 | Essler | 335/202 |
| 4,420,733 | 12/1983 | Palandri | 335/202 |
| 4,429,292 | 1/1984 | Schedele | 335/202 |
| 4,542,359 | 4/1985 | Ide et al. | 335/78 |

FOREIGN PATENT DOCUMENTS 539029 12/1955 France .

*Primary Examiner*—E. A. Goldberg
*Assistant Examiner*—Lincoln Donovan
*Attorney, Agent, or Firm*—John Francis Moran

[57] ABSTRACT

An electromagnetic relay of the type having an insulative base (1) which supports an electromagnetic assembly (2, 3) and a contact assembly (6) separated by partition walls (14, 15) includes a multipurpose retaining spring (4). The retaining spring is adapted to mate with the longitudinal portion (24) of the magnetic yoke and includes a plurality of tabs (411, 412 and 413) that dig into the insulative base securing it and the magnetic yoke into position. The retaining spring includes a flexible extension (43) located near a free end (243) of the magnetic yoke. An armature (3) is pivotally mounted on the free end and retained into position by the flexible extension of the retaining spring.

8 Claims, 2 Drawing Sheets

ELECTROMAGNETIC RELAY HAVING A MULTIFUNCTION RETAINING SPRING

CROSS-REFERENCE TO A RELATED APPLICATION

The present application is related to U.S. patent application Ser. No. 07/097,995 concurrently filed also on Sept. 17, 1987 which is directed toward a different aspect of the relay configuration wherein both inventions are utilized.

BACKGROUND OF THE INVENTION

1. Field of the Invention

The present invention relates to electromagnetic relays of the type having an insulating support structure for a coil including a yoke which together operate an angular armature adapted to pivot on an end of the yoke, and it relates, more particularly, to a retaining spring adapted to retain both the armature and the yoke (or frame) while positioning the armature against an edge surface of the armature serving as a fulcrum to operate an associated contact assembly.

2. Description of Prior Art

Various electromagnetic relays and configurations are known to those in the art and used wherein the coil including a yoke and an armature as well as a contact assembly are mounted on a common base or support structure. Typically, the support structure includes protruding walls for supporting the yoke and also provides insulative protection between the coil and the contact assembly.

For example, U.S. Pat. No. 4,429,292 discloses an electromagnetic relay having an insulating support structure with sidewalls and longitudinal grooves provided in the sidewalls for inserting and fastening a leg of the yoke. A retaining plate located between the yoke leg and the coil is supported against the yoke leg and has a pair of bent lateral flanges engaged in the grooves. For initial mounting of the retaining plate on the yoke, lateral fastening brackets are located on the plate for engaging plug projections that serve as lateral snap-in teeth on the yoke leg, thus presenting a rather complicated spring form and mounting procedure. In addition, a separate retainer spring is needed for pressing the armature against the yoke or a further structural addition is required in the spring form to serve as a separator plate between the armature of the relay and the yoke.

In U.S. Pat. No. 3,406,361 another relay configuration is disclosed which features a one-piece spring clip that is generally U-shaped for fastening the yoke to the relay base. However, this conventional U-shaped spring-frame embraces the coil from both sides and is quite large in size. Further, conventional springs in this form may present insulation problems. In addition in relays where the axis of the coil is perpendicular to the base, a U-shaped retainer clip is not easy to fasten on to the yoke leg which is also perpendicular to the base. Thus, such a conventional relay configuration leads to assembly difficulties.

SUMMARY OF THE INVENTION

Accordingly, it is a primary object of this invention to provide a relay having an improved retaining spring which is small in size and can easily be assembled with the yoke in a support structure.

Another object of the present invention is to provide a miniaturized electromagnetic relay which can be used for switching high voltage currents while providing good insulation between the contact assembly and the yoke and retaining spring assembly.

Another object of this invention is to provide an electromagnetic relay in which assembly and fastening the yoke does not require any additional space or mounting steps.

These and other objects are achieved in accordance with the principles of the present invention by providing a retaining leaf spring which is secured against the yoke in the assembly and has a spring retaining portion pressing the armature against the edge of an end of the yoke serving as a fulcrum. The retaining leaf spring has an extended flat portion located between a yoke leg and a partition wall of a support member and attached to the yoke leg. This flat portion of the retaining leaf spring is provided with tabs protruding therefrom that engage the partition wall and fixedly secures the yoke within the support structure.

BRIEF DESCRIPTION OF THE DRAWING

Features of the invention and additional objects of the invention will be more readily appreciated and better understood by reference to the following detailed description which should be considered in conjunction with the drawing.

DESCRIPTION OF THE PREFERRED EMBODIMENT

Figure 1:
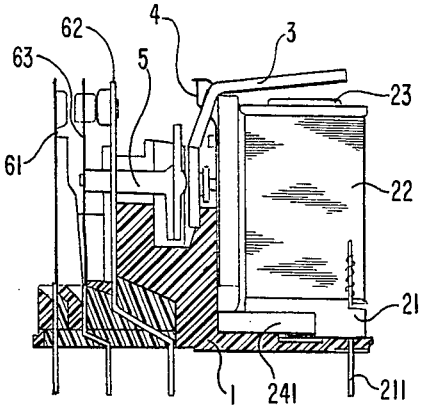
FIG. 1 is a side view of a completed electromagnetic relay constructed in accordance with the principals of the present invention wherein the base portion is shown in cross-sectional form.
Figure 3:
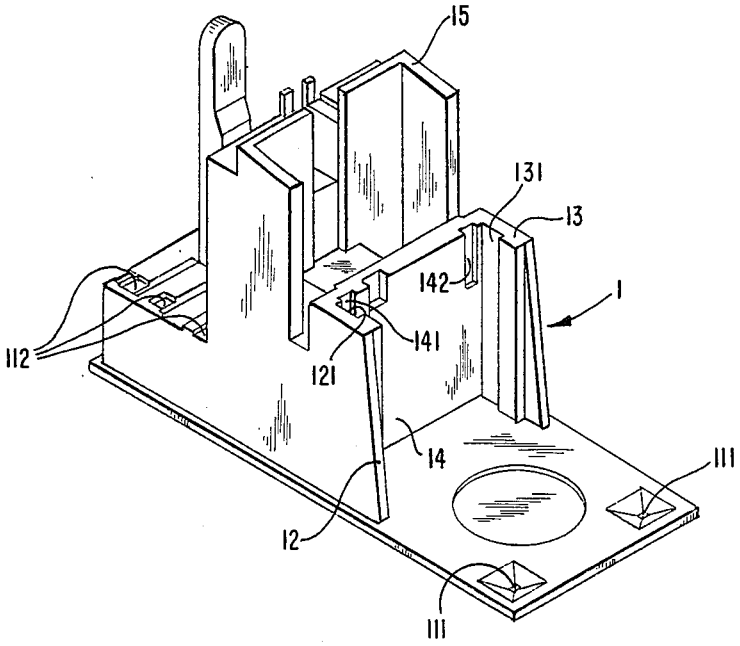
FIG. 3 is another perspective view in detail of only the support structure or base utilized in FIG. 2.
Figure 2:
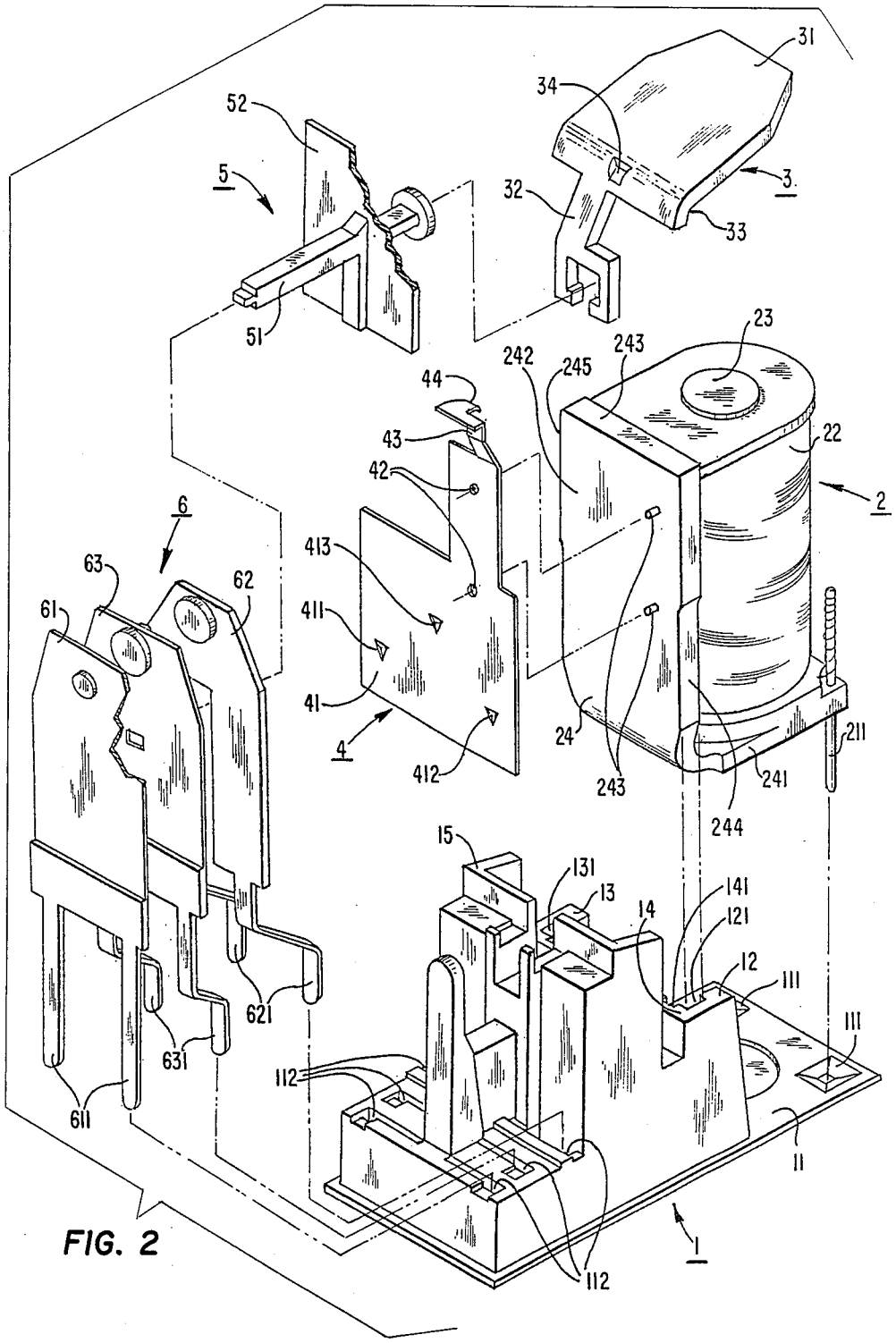
FIG. 2 is an exploded perspective view depicting the various individual component parts of the relay shown in FIG. 1.

The electromagnetic relay shown in FIGS. 1 through 3 comprises a support structure generally designated as 1, a coil and yoke assembly 2, an armature 3, a retaining spring 4, a pusher 5 and a contact assembly which is generally labelled 6.

The support structure 1 may be formed by molding, for instance by injection molding, from plastic material, for example from a polyphenylene sulfide resin, sold under the trademark RYTON. However, any suitable other insulating material may be used which is familiar to those skilled in the art. The support structure 1 comprises a generally flat base 11 with through holes 111 for receiving coil terminals 211. From the base 11, two sidewalls or lateral walls 12 and 13 extend perpendicularly and are connected by a partition wall 14 which extends also perpendicularly from the base 11 and divides the space above said base 11 generally into two regions. One of the regions serving to receive and contain the magnetic system or coil and yoke assembly 2, and the other region serving to receive and contain the contact assembly 6. This contact assembly 6 comprises generally two stationary contact elements 61 and 62 and a flexible contact spring 63 containing a contact which is mechanically actuated by the movement of the armature 3 via the pusher 5 to alternatively contact one or the other of the stationary contact elements 61 and 62. The contact elements 61 through 63 are inserted into slots 112 provided in the base 11 and they are secured therein by applying a suitable resin. In the illustrative embodiment, the contact elements 61 to 63 have terminal pins 611 through 631. These terminal pins 621 and 631 are bent within the base 11 so as to provide longer distances between their connecting ends. A contact assembly similar to that generally shown at 6 is illustrated and described in greater detail for example in U.S. Pat. No. 4,420,733, however, any other suitable design of contact elements may be readily used.

In accordance with the present illustrative embodiment of the invention, the partition wall 14 only extends about one-half the height of the coil assembly 2 providing clearance for free movement of the lower portion of the armature 3. An additional insulating wall 15 protrudes from the base 11 for guiding the pusher rod 51 and overlapping with a pusher collar 52 to provide a substantial insulating distance between the armature 3 and the contact assembly 6.

The magnet system or coil and yoke assembly 2 comprises a coil body 21 carrying a winding 22, a core 23 inserted in the coil body and an angled yoke 24 which has a first leg 241 extending perpendicular to the core and connected to the core 23. The angled yoke 24 having a second yoke leg 242 extending parallel to the core. At the free end of the core leg 242, edge 243 serves as a fulcrum 243 for receiving an interior bearing surface 33, or the interior portion of its angular vertex, of the angled armature 3. This armature 3 includes two basic portions. The first portion is a first armature leg 31 which completes the magnetic circuit of the armature 3 while providing a working air gap with the core 23. The second portion is a second armature leg 32 extending angularly to a generally parallel direction to yoke leg 242 and also engages the pusher 5 for actuation by transferring the motion of closing the air gap into moving the center contact 63 from one stationary contact to the other stationary contact.

The retaining spring 4 is generally made from a leaf spring material such as copper alloy, but may be made of any other suitably resilient metal. A flat first or planar portion 41 of the retainer spring extends parallel to yoke leg 242 and is secured against the Yoke leg. A pair of holes 42 are provided in the first portion 41 to mate with a corresponding pair of stand-offs 243 protruding from the yoke leg 242. A retaining arm 43 extends upward from the first portion 41 of the retaining spring 4 and terminates with an inwardly split extending along the direction of the length of arm 43 to provide an outwardly projecting bent tip end 44. Bent tip 44 Provides spring pressure at an indentation 34 of the armature 3. The retaining arm 43 extends from the first portion 41 offset to one side in order to allow unobstructed crossing with the asymmetrically shaped second armature leg 32. This offset enables the first portion 41 to be attached to the yoke leg 242 underneath the armature leg 32 while the retaining arm 43 provides downward pressure on the armature 3 via bent tip 44 from above.

For securing the retainer spring 4 and the yoke and coil assembly 2 within the support structure 1, a pair of longitudinal grooves 121 and 131 are provided in the interior portion of sidewalls 12 and 13 so as to face each other. Further, three tabs 411, 412, and 413 having a triangled groove-like shape are provided on the first portion 41 of the retaining leaf spring 4. These tabs 411, 412, and 413 may be made by punching material partly out from the first part 41 in a process known as lancing or by any other suitable method, and they may also have any other suitable shape. It is only essential that their shape allows insertion of the retainer spring 4 together with the yoke leg 242 in a downward direction into the support 1 while biting, or digging into the plastic material of the support structure for preventing pulling the parts out in a reverse direction. Corresponding to the tabs 411 and 412, a pair of clearances 141 and 142 are provided in the partition wall 14 as shown in detail in FIG. 3. A third clearance 143 is provided for receiving the lower stand-off 243 when the yoke leg 242 is inserted into the grooves 121 and 131.

The retainer spring 4 and the coil and yoke assembly 2 are mounted in the following way. At first, the retainer spring 4 is placed with its first part 41 against the outer surface of the yoke leg 242, the stand-off 243 engaging the holes 42. Then, these parts pre-assembled in this way are pushed downward into the support structure 1 by inserting the side edges 244 and 245 into the corresponding grooves 121 and 131, respectively. In the first stage of this inserting, the tabs 411 and 412 come into the clearances 141 and 142, respectively, thus allowing proper adjustment of the parts with respect to each other and insertion of the coil terminals 211 into the openings 111. With a final inserting action, at the ends of the clearances 141 and 142, the tabs 411 and 412 slide on the surface of the partition wall 14 thus pressing the yoke leg 242 against the opposite sides of the grooves 121 and 131.

The tabs 411, 412, and 413 bite into the material of the partition wall 14, thus preventing the removal of the yoke leg 242 and the retainer spring in the reverse direction. Then, the pusher 5 and the armature 3 are mounted and a cover (not shown) may be mounted on the support structure.

There has thus been shown and described a novel electromechanical relay which fulfills all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

I claim:

1. An electromagnetic relay including a contact assembly having at least one movable contact comprising:

(a) an insulative support structure having a generally planar base, a pair of sidewalls and a partition wall extending perpendicularly from said base, said partition wall extending across said base and connecting said sidewalls and each of said sidewalls including a longitudinal groove therein oriented perpendicular to said base and the pair of sidewalls each having a groove forming a pair of grooves facing each other;

(b) an electromagnetic coil having a central axis oriented perpendicularly to said base;

(c) a magnetic yoke having a base portion for supporting one end of the coil and a longitudinal portion extending parallel to the central axis and parallel to said partition wall and inserted into said pair of grooves and the longitudinal portion having an edge serving as a fulcrum;

(d) an armature having a generally angular shape wherein the inside of the angle includes a bearing surface pivoted on the edge of the fulcrum; and (e) a retaining leaf spring secured to said yoke and having a spring retaining portion pressing said armature against said fulcrum;

said retaining leaf spring having an extended flat portion disposed between the longitudinal portion and said partition wall and attached to the longitudinal portion and having tabs protruding therefrom for engaging said partition wall for securing said yoke rigidly within the pair of grooves in said support structure.

2. An electromagnetic relay in accordance with claim 1, wherein said tabs protrude from said leaf spring in a direction facing away from said base and bite into said partition wall to prevent the longitudinal portion of the yoke from being removed out of said grooves after assembling.

3. An electromagnetic relay according to claim 2, wherein said tabs are bent out from the leaf spring in the form of a triangulated shape including tips pointing toward the planar portion of said base.

4. An electromagnetic relay in accordance with claim 1, wherein the extended spring portion is clamped between said yoke leg and said partition wall including at least one hole therein and at least one stand-off protrudes from said yoke leg and mates with the at least one hole provided in said spring portion to secure said yoke and said retaining leaf spring in the pair of grooves.

5. An electromagnetic relay in accordance with claim 1, wherein said partition wall has clearances corresponding to at least a portion of travel during insertion into the pair of grooves for said tabs at the upper edge of the partition wall to facilitate insertion of said yoke and leaf spring into said grooves.

6. An electromagnetic relay in accordance with claim 1, wherein said tabs are located symetrically with respect to a center line between said two sidewalls.

7. An electromagnetic relay in accordance with claim 6, wherein said spring extension includes three tabs, two of these three tabs located the same distance away from the lower end of said extension, which is adjacent to said base, and the remaining tab of the three tabs located centrally between said sidewalls at a greater distance from said lower end than the pair of tabs.

8. An electromagnetic relay having a plurality of electrical contacts including a contact assembly having at least one movable contact responsive to an electromagnetic coil comprising:

(a) a base portion including a first generally planar exterior surface and a plurality of projecting walls extending away from and substantially perpendicular to the generally planar exterior surface, the plurality comprising a first pair of walls extending from opposite sides of the exterior surface so as to face each other, the plurality including a third wall spanning the distance between the first pair of walls, each of the first pair of walls including a longitudinal groove extending orthogonal to the exterior surface so as to form a pair of grooves facing each other and disposed a distance apart from one another;

(b) a magnetic yoke having a base portion for supporting the electromagnetic coil at one end and a longitudinal portion, at least a portion of the edge regions having a distance therebetween along a longitudinal portion thereof corresponding to the distance between the pair of grooves and adapted for insertion into the pair of grooves so that the longitudinal portion is oriented essentially parallel to the third wall, the longitudinal portion having a free end located near the other end of the electromagnetic coil;

(c) retaining means for securing the yoke in position, the retaining means having a flat portion including locking means and adapted to mate with the longitudinal portion of the yoke and having a resilient extension extending above the free end of the magnetic yoke, the retaining means and the yoke inserted into the pair of grooves together while the locking means secures the retaining means and the yoke therein; and (d) an armature having a generally angular shape including a first portion and a second portion extending generally orthogonal to the first portion and forming an inner bearing surface at its vertex substantially extending across the width of said first portion, the bearing surface resting on the free end of the magnetic yoke and pivotally retained thereon by the resilient extension to be responsive to the electromagnetic coil for operating the at least one moveable contact.

* * * * *